US006174381B1

(12) United States Patent
Ignatiev et al.

(10) Patent No.: US 6,174,381 B1
(45) Date of Patent: Jan. 16, 2001

(54) METHOD FOR CLEANING THE INNER SURFACES OF PIPES MAINLY FROM SOLID DEPOSIT AND DEVICE FOR REALIZING THE SAME

(75) Inventors: Vladimir Alexeevich Ignatiev; Viktor Pavlovich Kozlov; Ivan Alexandrovich Borzenkov, all of g.Belgorod (RU)

(73) Assignee: Tovarischestvo S. Ogranichennoi Otvetstvennostju Nauchoproizvodstvennoe Predpriyatie "Splavy", Belgorod (RU)

( * ) Notice: Under 35 U.S.C. 154(b), the term of this patent shall be extended for 0 days.

(21) Appl. No.: 09/194,030

(22) PCT Filed: May 14, 1997

(86) PCT No.: PCT/RU97/00152

§ 371 Date: Nov. 16, 1998

§ 102(e) Date: Nov. 16, 1998

(87) PCT Pub. No.: WO97/43057

PCT Pub. Date: Nov. 20, 1997

(30) Foreign Application Priority Data

May 16, 1996 (RU) ..... 96108809

(51) Int. Cl.[7] ..... B08B 9/04

(52) U.S. Cl. ..... 134/8; 15/104.05; 15/104.09; 15/104.13

(58) Field of Search ..... 15/104.03, 104.05, 15/104.09, 104.13, 104.14, 104.12, 104.31; 134/8

(56) References Cited

U.S. PATENT DOCUMENTS

| | | | | |
|---|---|---|---|---|
| 1,579,692 | * | 4/1926 | Ernst | 15/104.12 |
| 1,873,521 | * | 8/1932 | Young | 15/104.14 |
| 2,015,973 | * | 10/1935 | Staley | 15/104.14 |
| 2,045,761 | * | 6/1936 | Elliot | 15/104.14 |
| 2,103,760 | * | 12/1937 | Turner | 15/104.14 |
| 2,597,263 | | 5/1952 | Elliot . | |
| 2,692,752 | * | 10/1954 | Heiss | 15/104.12 |
| 2,735,123 | * | 2/1956 | Mueller et al. | 15/104.09 |

FOREIGN PATENT DOCUMENTS

| | | |
|---|---|---|
| 2028839 | 2/1995 | (RU) . |
| 1013002 | 4/1983 | (SU) . |
| 1215768 | 3/1986 | (SU) . |
| 1618277 | 12/1990 | (SU) . |

* cited by examiner

*Primary Examiner*—Randall E. Chin

(57) ABSTRACT

A method and apparatus for cleaning the internal surface of pipes mainly from solid sediments, according to which a cleaning element is inserted into the pipe cavity and rotated at a high speed while fluid is simultaneously supplied to the pipe cavity. The cleaning element comprises a plurality of roller heads with annular grooves coupled to a housing and the roller heads are shifted relative to each other in the axial direction. During cleaning, the roller heads and the housing rotate around their respective longitudinal axes in a manner such that the rotation of the roller heads is opposite in direction relative to the rotation of the housing. While rotating, the cleaning element creates spiral grooves in the sediment and cuts off the sediment along the spiral path.

8 Claims, 6 Drawing Sheets

METHOD FOR CLEANING THE INNER SURFACES OF PIPES MAINLY FROM SOLID DEPOSIT AND DEVICE FOR REALIZING THE SAME

FIELD OF THE INVENTION

The invention relates to the technique and technology for cleaning the internal surface of pipes from various sediments and may be utilized in a series of branches of the industry: chemical, energetical etc., and particularly, for cleaning the condenser pipes during their exploitation from the carbonate sediments.

BACKGROUND OF THE INVENTION

Currently performed researches of the effectiveness of power generating units have shown that significant power losses occurs caused by some reasons including the increased thermal pressure on account of forming solid (mainly carbonate) and soft (organic and oozy) sediments in condenser pipes.

An analysis of the background of the invention has shown that the existed problem consisting in cleaning the internal surfaces of the pipes, including condenser pipes, from the solid sediments is solving by a plurality of methods implemented in particular devices.

All the variety of known means for cleaning may be divided into two main groups: chemical and mechanical ones.

The essence of the chemical methods for cleaning consists in the preparing the solution of the caustic soda or hydrochloric acid, supplying the prepared solution to the pipe cavity being cleaned, and subsequent washing the pipes.

Chemical methods for cleaning allow to clean the internal surface of the pipes from the solid carbonate sediments but they characterized by the following drawbacks:

corrosion of the metal of cleaned surfaces;

possibility of the pollution of the environment;

toxicity of applied reagents;

high cost of used reagents and equipment.

All the variety of known mechanical means for cleaning may be divided into cleaning the pipes continuously during operation and cleaning the pipes periodically.

A method for cleaning the internal surface of pipelines from the solid sediments by using the washing-out ability of the high pressured fluid stream is known, wherein the pressure difference is produced for dividing the fluid flow in the pipeline into two streams, one of which is used in the turbine for transforming the other stream into a high pressure stream, and then both streams are directed towards the internal surface of pipeline and moved along it by the spiral line (USSR Author's Certificate [1] 268103, Int.C1.6 B 08 B 9/04, 1968).

Another method for cleaning the internal surface of pipeline is known, said method being executed by means of treating the internal surface of the pipe with a cleaning device rotated within the pipe by affecting that device with the pressure of the working agent flow orienting it towards the movement of the cleaning device, the contact of the latter with the internal surface of pipeline is carried along the spiral line, the direction of which step is opposite the flow movement while moving it in the direction of the cleaning device rotation (USSR Author's Certificate [1] 1243846, Int.C1.6 B 08 B 9/04, 1984).

Yet another methods for periodical cleaning are known, wherein, before the cleaning, the cavity is blown through by a pistol first with the water and then with the air, and at the ends of pipes a beginning bore is made with a reamer in solid sediments to pass a cleaning element through them. After this the cleaning element is placed into the formed beginning bore and moved by supplying the water under the pressure of 2 to 6 atm within the cavity being cleaned. Sediments are cut off during the interaction with cutting edges of the cleaning element. The cleaning element is done as three or four split bushings placed on the rod, the cutting edges of those bushings having different diameters increasing in the direction opposite the direction of the cleaning element movement. Such a technology is used by Conco (Conco Systems, Inc., 1995, Printed in U.S.A.).

An analogous technology is used by Arcor International Ltd. The difference from the described technology consists generally in the cleaning element used. It is formed as a brush made from the steel wire, moving in the pipe cavity being cleaned under the influence of a continuously supplied water and pulsingly supplied air.

A well-known method used by TAPROGGE may be referred as a method for continuous cleaning by pumping the fluid with inserted beads through the pipe cavity. Surfaces of the beads have spikes or are covered with the corundum coating or polishing material depending on the level of pipe clogging and the stage of the cleaning operation. During the circulation of beads in the pipe cavity and interaction with bead coating the sediments in a cavity being cleaned are destroyed and flown away by the fluid flow. As the beads become worn they are sifted out and removed from the cleaning process while passing through the unit of their size control.

In the analogous technology also known from the USSR Author's Certificate [1] 186929 Int.C1.6 F 28 G 1/12, B 08 B 9/04, 1984, the beads are made from a material which linear expansion coefficient is chosen larger than the expansion coefficient of the pipe material. As the pipe cavity becomes cleaner the temperature of the fluid pumped through it, is made higher which causes the temperature increase of the beads being in it, and therefore the increase of their diameter. This, in turn, allows to cut off the sediment products gradually, layer by layer, thereby increasing the quality and effectiveness of the cleaning.

Aforementioned technical decisions characterizing mechanical methods for cleaning solve partially problems existed in such technologies, but during the process of their realization, particularly when cleaning from solid carbonate sediments, the quality of such cleaning does not always meet the presented requirements. Moreover, the cases of damaging the internal surface of the pipe occur during the cleaning which leads to their rapid corrosion and to premature finishing their exploitation. A series of other inconveniences, for example, difficulties in removing the stopped cleaning elements (brushes, beads), and also a need to heat the passed fluid for increasing the bead size etc., stimulate actions for the further development of mechanical methods for cleaning.

The method, most close to the present invention by its technical essence and a result being achieved while its using, is a method for cleaning the internal surface of the pipes, which method consists in moving within the pipe cavity being cleaned a solid working body in the form of a pig placed with a gap relative to the walls of the pipe being cleaned for producing the cavitation and a pressure of the fluid working agent onto the end surface of the working body. A pressure of 70 to 700 kgf/cm$^2$ is produced at the initial section of the pipe and maintained during the time period sufficient for passing the working body through the pipe cavity being cleaned.

After finishing one cleaning cycle, in the next cycle the working body is used of a size larger than in previous cycle, and the water is used as a fluid working body (USSR Patent [1] 1618277, Int.C1.6 B 08 B 9/04, F 28 G 1/13, published 1990).

The present method partially removes problems typical for the known method although its utilizing also doesn't provide the required quality of the cleaning. Moreover, it is necessary to have a sufficiently complex regime for setting up the interaction between the fluid working agent and the working body and some complexity in determining the optimal size of the working body.

A device for cleaning the internal surface in known consisting of a thrower having an axial opening for passing a fluid working agent, the thrower being positioned by the attachment mechanism, and a drive for the longitudinal movement of the thrower for supplying workings bodies into the pipe, a magazine for the working bodies, a high pressure source for the fluid working agent, means for controlling the movement of the thrower depending on the existence of the working body, the attachment mechanism of thrower including horizontal or vertical supporting guide elements positioned with a possibility to move relative to each other, and the horizontal or vertical supporting guide elements are provided with a supporting element for positioning at least one thrower.

Moreover, the device includes an adjusting means for changing the distance between the thrower and a pipe cavity being cleaned.

The device also has an additional means for positioning the driving element, which means includes a guide pipe and a power cylinder in which the thrower is positioned along the cylinder axis passing through the cylinder' piston and rigidly coupling with it, the guide pipe being positioned partially in the power cylinder housing and springed relatively to the internal surface of power cylinder, and partially behind the power cylinder housing for positioning on it the working bodies' magazine, and a sealing element is positioned on the free end of the pipe and springed relatively to the axis of the pipe for the incomplete sealing between the tip of the thrower and an end surface of the pipe being cleaned.

Means for controlling the thrower depending on the presence of the working body has sensors of the working body position placed on the guide pipe on the side opposite the magazine with working bodies (USSR Patent [1] 1618277, Int.C1.6 B 08 B 9/04, F 28 G 1/13, published 1990).

The known device is not sufficiently effective and it doesn't provide the required quality of the cleaning when cleaning the solid sediments.

The device, most close to the present invention by its technical essence and a result being achieved while using, is a device for cleaning the internal surface of the pipeline having a housing, a main turbine placed on the shaft coaxially with the housing and coupled with it, an additional turbine placed on the other end of the shaft with a possibility to rotate relatively to it, a water supply system, the additional turbine being provided with a spherical rim having cleaning elements placed on it, and a shaft section with the additional turbine is oriented at an angle to the housing axis (USSR Author's Certificate [1] 1013002, Int.C1.6 B 08 B 9/04, 1983).

However, the known device is not sufficiently effective, particularly, in cases of plugging the pipes with solid, carbonate sediments. The possibility of damaging the internal surface of pipes is not excluded and the design of the device doesn't allow to use it for cleaning of small diameter pipes.

SUMMARY OF THE INVENTION

The basis of the present invention is a problem to produce a method for cleaning the internal surface of pipes which method provides an effective cleaning mainly from the solid, carbonate sediments without damaging the surface being cleaned, and also an elaboration of a device being less complex with respect to the design, and having an ability of effective cleaning the small diameter pipes.

The given problem is solved with an achievement of mentioned technical result as follows: in the method for cleaning the internal surface of the pipes mainly from the solid sediments including steps of inserting the cleaning element into the pipe cavity being cleaned, rotating the cleaning element with the simultaneous supplying the water into the pipe cavity, moving the cleaning element in the pipe cavity for destroying and cutting off the solid sediments from the pipe surface and removing the destroyed and cut off sediments from the cleaning zone, rotating the cleaning element with a speed no less than 1000 turns per minute, rotating the housing having roller heads and rotating the roller heads being performed around their axis, respectively, clockwise and counterclockwise relative to each other, the step of moving the housing having roller heads being performed by the spiral line with cutting the spiral grooves in the sediments, deeping and broadening the grooves while moving, and chopping off the sediments while contacting the limiting rollers' working surface of the working element roller head with sediments, and contacting the roller's external surface with the pipe internal surface, the fluid flow is supplied to the rear working surface of limiting rollers, and is also solved by performing, before the step of inserting the cleaning element into the pipe cavity being cleaned, the beginning bore in the form of a truncated cone having an angle of slope of its generatrix equal to the angle of slope of generatrix of roller head truncated cone.

The given problem is solved also by elaborating the device for executing the method for cleaning the internal surfaces of pipes from preferably solid sediments, which device comprises a housing having a cleaning element attached to one of the housing end surfaces at an angle to its longitudinal axis which element is made in the form of a roller head with an ability to rotate around its axis, and bores are made in the housing to supply the fluid, the device comprising at least one additional roller head having annular grooves, and every roller head having annular grooves is made in the form of a truncated cone formed by rollers placed with a consecutive increase of their diameters in the direction opposite the direction of the device movement, and the slope angle of the axis of roller heads with annular grooves to the longitudinal plane, going through the housing axis, is determined by the equation:

$$\alpha = \mathrm{arctg}\ n \cdot l / \pi \cdot d_p,$$

where n is a number of roller heads, l is a distance between rollers, $d_p$ is an internal diameter of the pipe, roller heads being shifted in an axial direction relative to each other, and bores for supplying the fluid being made in communication, one bore is coaxial with the longitudinal axis of the housing and the second bore is on its external surface, and the other end surface of the housing is coupled to the rotation drive of the housing through the holder by means of the flexible communication.

The value of roller heads' shift is determined by the equation:

$$\Delta = l/n,$$

where l is a distance between rollers, n is a number of roller heads.

The angle of the truncated cone generatrix slope to the pipe surface is determined by the equation:

$$\beta = \text{arctg}\ l \cdot k/t,$$

where l is a distance between rollers, k is a number of rollers in the head, t is a thickness of solid sediments.

In addition, rollers in the head are placed step-by-step, the number of rollers in the step being chosen equal to the number of heads.

Rollers are made in the form of a disc with sharp edges, and rollers of the last step in every head are limiting and their edges are cylindrical and the height of cylinder is chosen equal of 0.1 to 0.3 of disc thickness.

The bore on the housing surface for supplying the fluid is made in the form of a spiral line the direction of which is opposite the direction of the housing rotation.

Such an embodiment of the device allows to increase the effectiveness of the cleaning without damaging the surface of small diameter pipes cavity being cleaned.

BRIEF DESCRIPTION OF THE DRAWINGS

Further the invention will be explained by the examples of embodiments with reference to the attached drawings, in which.

THE BEST EMBODIMENT OF THE INVENTION

Figure 1:
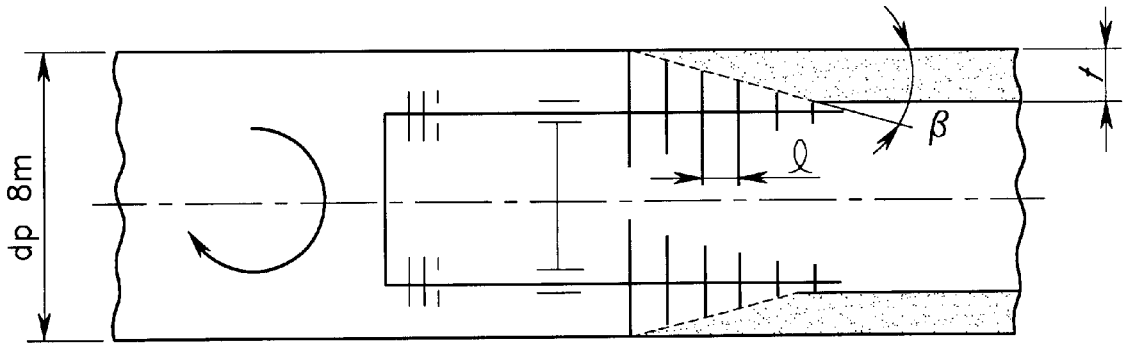
FIG. 1 shows a scheme of arrangement of roller heads in the cavity of the pipe being cleaned.

The claimed method solves the problem of increasing the effectiveness of cleaning mainly from the solid, carbonate sediments.

Technical result achieved while implementing the claimed method consists in increasing the effectiveness and quality of the cleaning with shortening the time and labor expenditures on its performing, and is implemented on account of suggested regimes and consequence of operations of the interaction between roller heads and sediments.

Method for cleaning the internal surface of the pipes mainly from the solid sediments is performed as follows.

A housing having roller heads is inserted into the pipe cavity being cleaned and set in rotation, and a fluid is supplied simultaneously. The rotation is performed with a speed no less than 1000 turns per minute. The cleaning element execute a complex movement: the housing having roller heads is rotated clockwise and roller heads are rotated around their axis counterclockwise. The movement of the housing having roller heads in the pipe cavity being cleaned is performed along the spiral line with cutting the spiral grooves in the sediments, which grooves are deeped and broadened with consequent rollers. When limiting rollers enter the grooves they interact with the sediments by their working surface, and they interact with the pipe internal surface being cleaned by the external cylindrical surface. At the moment of these two contacts the limiting rollers crush the sediments chopping them off, and a fluid flow supplied to the rear working surface removes the sediments in the direction of the movement of the housing having cutting heads.

The method for cleaning are executed by a device especially made for its realization. It comprises at least two roller heads having annular grooves fixed on the end surface of the housing with an ability to rotate around its axis.

Roller heads are positioned at the angle β to the longitudinal axis of the housing, which angle is determined by the equation:

$$\alpha = \text{arctg}\ n \cdot l/\pi \cdot d_p,$$

where n is a number of roller heads, l is a distance between rollers, $d_p$ is an internal diameter of the pipe.

Rollers having annular grooves positioned on every roller head form a truncated cone which vertex is oriented in the direction of the device movement. The angle β between the cone generatrix and the pipe surface is determined by the equation:

$$\beta = \text{arctg}\ l \cdot k/t,$$

where l is a distance between rollers, k is a number of rollers in the head, t is a thickness of solid sediments.

Knowing the value of the angle β it is possible to determine the roller diameter difference on each roller head. Rollers on the head are arranged step-by-step and the number of rollers in each step corresponds to the number of roller heads in the device. The number of roller heads depends on the diameter of the pipe being cleaned.

Roller heads are shifted in axial direction relative to each other on the value Δ, which is determined by the equation:

$$\Delta = l/n,$$

where l is a distance between rollers, n is a number of roller heads.

Step-by-step arrangement of rollers in the head and their shift in the axial direction relative to each other provides the cutting of the spiral grooves in the sediments which grooves then are deeped and broadened with limiting rollers. Simultaneously, their cylindrical surfaces are in contact with the internal surface of the pipe being cleaned, chopping off and crushing the sediments while the limiting rollers preserve the pipe from the damages.

The using of more than one roller head in the device allows to reliably center the device within the cavity being cleaned, to exclude its warp or wedging during the cleaning.

Figure 2:
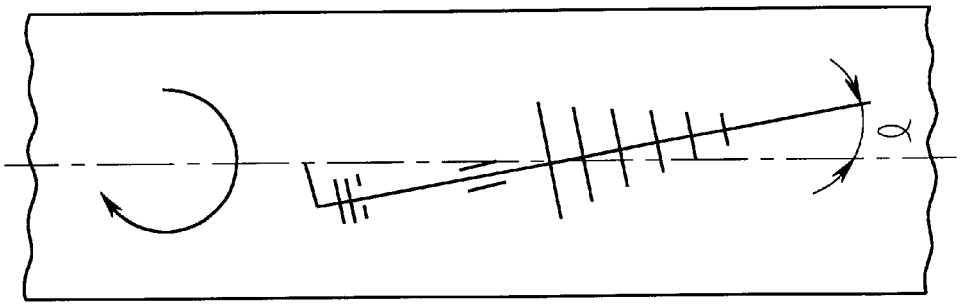
FIG. 2 is a schematic view of an angle of the roller head slope to the device housing axis and to the axis of the pipe being cleaned.
Figure 3:
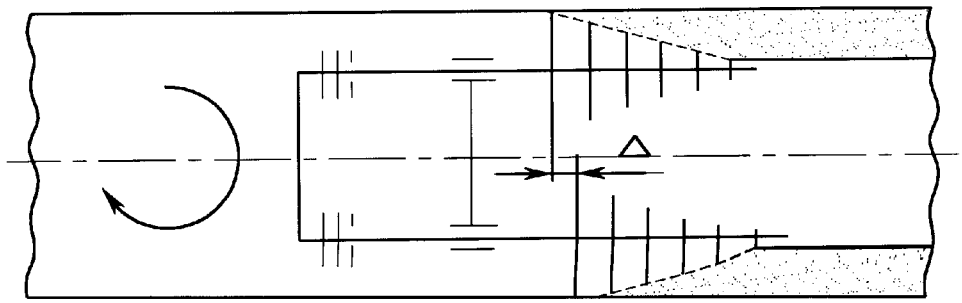
FIG. 3 shows a shift of roller heads in the axial direction relative to each other.
Figure 4:
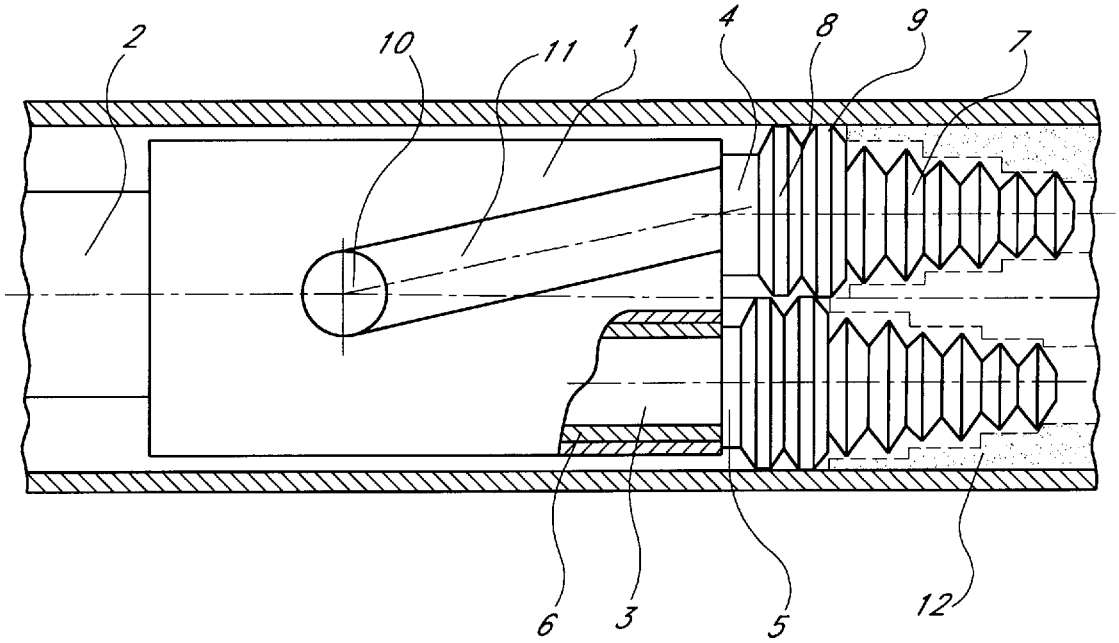
FIG. 4 is a schematic view for positioning the device in the pipe cavity being cleaned.

The device comprises the housing 1 having a shank on its the rear part for coupling the flexible shaft 2 for transferring the torque, and, in its front part, apertures are made from the end surface, in which apertures the bars 3 of cutting roller heads 4 and 5 are mounted in bearings 6. The bars 3 of cutting roller heads 4 and 5 are mounted at the angle β to the axis (FIG. 2) of the device housing positioned within the pipe. The angle β is determined by the equation:

$$\alpha = \text{arctg}\ n \cdot l / \pi \cdot d_p,$$

where n is a number of roller heads, l is a distance between rollers, $d_p$ is an internal diameter of the pipe; the bars of heads are inclined to the side opposite the direction of the device housing rotation (shown with the arrow on FIGS. 1, 2, 3). Due to the inclination of roller head axes to the direction opposite the accepted direction of the device housing rotation, the roller heads rotating around their axis assist the device in its movement in the pipe cavity being cleaned. Cutting rollers 7 are placed on the bars of roller heads forming the "taking part" of the head. Rollers are made in the form of a disc with sharp edges, and rollers of the last step in every head are limiting rollers 8 and their edges 9 are cylindrical and the height of that cylinder is chosen equal of 0.1 to 0.3 of the disc thickness (FIG. 4). The height of the cylinder is determined by the experiment: the disc made with lower height of the cylindrical edge produces scratches on the pipe surface being cleaned, the disc made with higher height delays the movement of the device. The roller head has a form of a truncated cone with a step-by-step generatrix. Every step in the given case consists of two rollers of equal diameter, and a number of rollers in the step is stipulated by the number of heads in the device (FIG. 4). The last step at the basis of the cone is formed by limiting rollers 8. Roller heads 4 and 5 are shifted relative to each other in the axial direction on the value Δ (FIG. 3), which is determined by the equation:

$$\Delta = l / n,$$

where 1 is a distance between rollers, n is a number of roller heads. An internal bore 10 and an external bore 11 are made in the housing 1 for supplying the fluid (water). The bore 10 is made through the housing, and on the housing periphery it transfers into external spiral bore 11 with the direction of the spiral line opposite the direction of the rotation of the housing 1. Such construction of the bores assists to speed up the water flow thereby increasing the quality of the cleaning. Solid carbonate sediments on the pipe surface are designated as 12.

Device also comprises a holder 13 made in the form of a hollow pipe having a bushing 14 placed inside coaxially to its longitudinal axis. By one end the bushing is coupled with the device housing 1 and on the other end it have a shank 15 for fixing the flexible shaft 2. At the second end of the holder 13 a nipple 16 is fixed to connect the hose 17 for fluid supply.

The device is working as follows.

Figure 5:
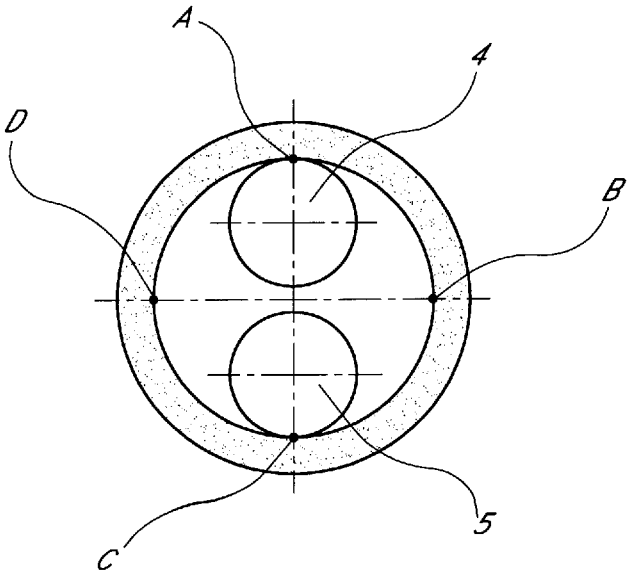
FIG. 5 is a scheme of the movement of roller heads in the pipe cavity being cleaned (in the radial plane)
Figure 6:
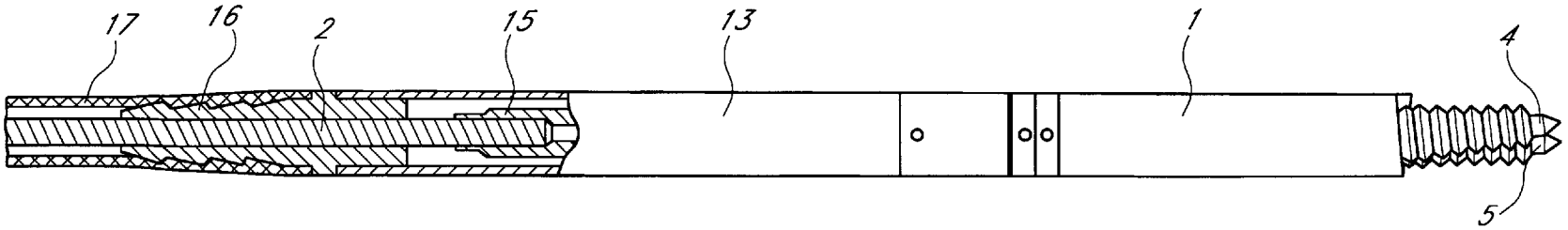
FIG. 6 shows the assembled device with a holder, a flexible rope, a nipple and a hose for the water supply.
Figure 7:
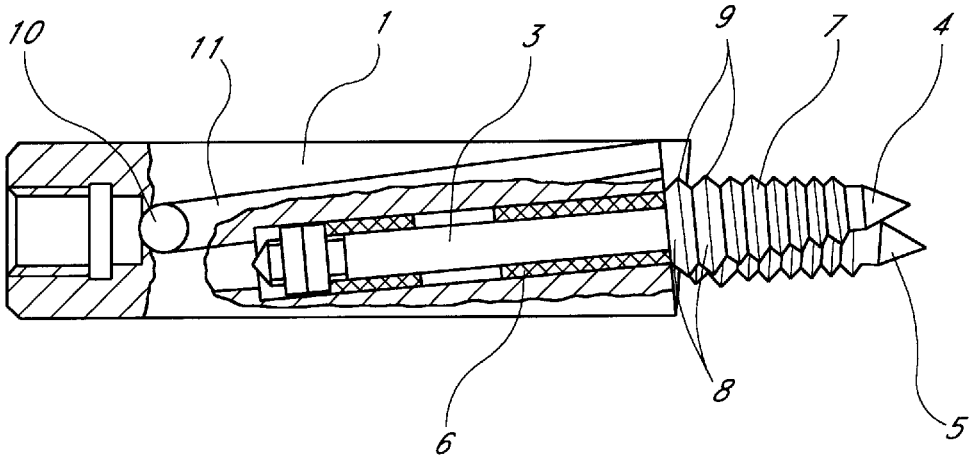
FIG. 7 is a cross-section of the device housing with roller heads placed in it.
Figure 9:
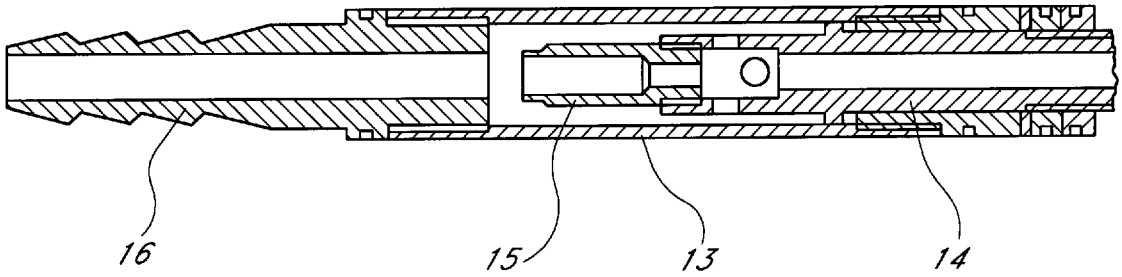
FIG. 9 is a cross-section of the device holder.
Figure 8A:
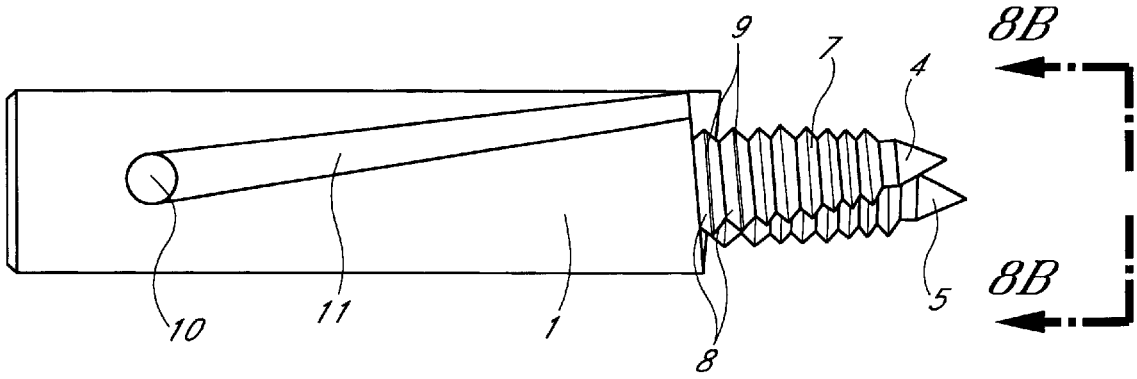
FIG. 8 shows seting up roller heads and producing bores for the water supply.
Figure 8B:
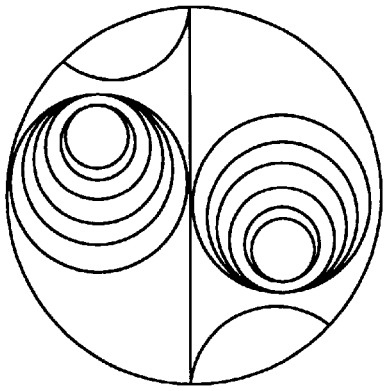
Figure 10:
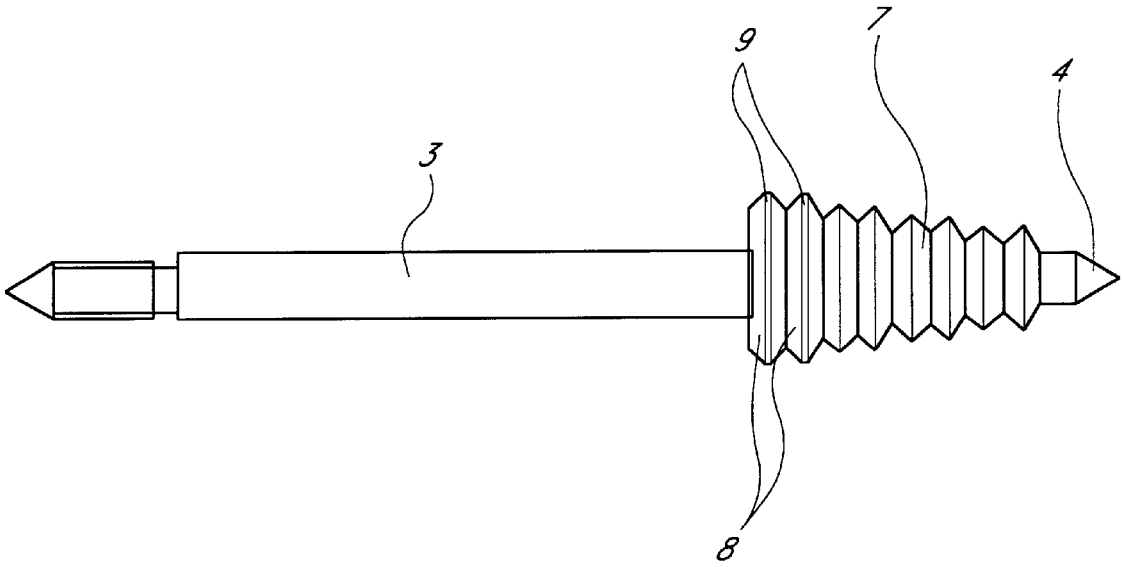
FIG. 10 shows the roller head made as a whole with an axis.

The device housing 1 is inserted into the pipe cavity till the contact of the first roller 7 of head 4 with solid sediments 12 on the pipe surface at the point A (FIG. 5). In doing this the roller head 5 being in the point C doesn't come into the contact with sediments on the distance Δ equal to the axial shift between heads 4 and 5. Then the device housing 1 is rotated by the external drive (not shown) and initially pressed along the axis. When rotating on 90° the head 4 (the roller 7 of the head 4) cuts a spiral groove in the sediments and simultaneously, in point B, moves in the axial direction on the value Δ. At this time the head 5 moves from the point C to the point D and contacts the sediments 12 in the pipe cavity. When rotating the housing 1 on 180° in the point C the first roller 7 of the head 4 moves in the axial direction on the value of the step between rollers, and the first roller 7 of the head 5 in the point A moves in the axial direction on the value Δ. In doing this the second roller of the head 4 contacts the sediments in the pipe at the point C. When rotating the housing 1 on the 270° the second roller of the head 5 contacts the sediments in the pipe at the point B. Thus, when two roller heads are in pipe sediments, rollers cut four spiral grooves with a step between grooves equal to Δ (axial shift between the heads). When rotating the housing 1 on 360° the first roller of the head 4 moves in the axial direction on a doubled value of the step between the rollers, and second roller moves on the value of one step. When working surfaces of limiting rollers 8 get into contact with sediments on the internal surface of the pipe, rollers chop off (crash) the remained sediments while being in contact with the internal surface of the pipe by cylindrical edges; and since the peripheral surface of the rollers made cylindrical the pipe surface being cleaned doesn't undergo damages. Simultaneously, the water passes via bores 10 and 11 of the device housing making the cut sediments suspended and removes the latter from the pipe cavity in the direction of the device movement.

Such an embodiment of the device allows to clean the pipe cavity from the solid, carbonate sediments more effectively without damaging its surface, by ecologically pure method.

EXAMPLE OF AN EMBODIMENT OF THE METHOD

The method was tested on the heat exchanger of one of nuclear power stations. The length of the heat exchanger pipe was 9000 mm, the internal diameter was 25 mm, the water was supplied under the pressure of 4 atm., the thickness of carbonate sediments was, on the average, ~2.5 mm, the rotation frequency of the device was 4000 turns per minute.

In order to clean the condenser pipe a device was used having a housing with two roller heads fixed of one of its end surfaces arranged with an ability to rotate at an angle to the axis of the device housing.

The device was inserted into the pipe cavity till the contact of the first roller of the roller head with carbonate sediments, was rotated with pneumatic drive and was initially pressed in the axial direction. While penetrating the first rollers into the sediments the device began to move in the pipe cavity cleaning it from the sediments. Simultaneously with the starting of the device rotation drive the water was supplied under pressure and while passing through the external and internal bores of the device housing it washed out sediment cuttings in the direction of the device movement.

The pipe having the length 9 m and the internal diameter 25 mm was cleaned in 50 seconds. No remains of sediments were found. Also, no damages of the internal surface of the pipe were observed.

INDUSTRIAL APPLICABILITY

The claimed method and apparatus for cleaning the internal surface of the pipes mainly from solid sediments will find widespread use for cleaning the pipes in various branches of the industry providing an effective cleaning, excluding the damages of internal surfaces of pipes and not disturbing the ecology of the environment.

What is claimed is:

1. A method for cleaning an internal surface of a pipe mainly from solid sediments, comprising the steps of:

providing a cleaning element having a housing and at least one roller head coupled to the housing, wherein the roller head comprises a plurality of cutting rollers and a limiting roller with a front working surface, a rear working surface and an external edge surface;

inserting the cleaning element into the pipe;

rotating the element and simultaneously supplying a fluid flow to the pipe;

moving the cleaning element in the pipe for destroying and cutting off the solid sediments from the internal surface of the pipe and removing the destroyed and cut off sediments from a cleaning zone;

wherein the rotation of the cleaning element is performed with a speed no less 1000 turns per minute, wherein the roller head and the housing rotate around their respective longitudinal axes in a manner such that the roller head rotates in an opposite direction relative to the rotation of the housing and, wherein the rotation of the roller head results in the cutting rollers forming a spiral groove in the sediments and wherein the housing is moved in the direction of the spiral groove such that the movement of the housing causes the front working surface of the limiting roller to contact the sediments and chop off the sediments from the internal surface of the pipe while fluid is supplied to the rear working surface of the limiting roller.

2. The method of claim 1, wherein before the step of inserting the cleaning element into the pipe, a first bore is formed in the sediments so as to facilitate the insertion of the cleaning element into the sediments wherein the first bore comprises a first truncated cone having a first angle of slope of generatrix that is substantially equal to a second angle of slope of generatrix of the cleaning element.

3. A device for cleaning internal surface of a pipe mainly from solid sediments comprising:

a housing having a first longitudinal axis, a first end surface and a second end surface defining, therebetween, the length of the housing along the longitudinal axis, and a bore for supplying a fluid;

at least two roller heads attached to said first end surfaces, each said roller head being in the form of a truncated cone formed by a plurality of rollers separated by annular grooves defining a distance between adjacent rollers;

wherein each said roller has a second longitudinal axis defining the longitudinal direction of said truncated cone, and the second longitudinal axis and the first longitudinal axis form an angle, $\alpha$, wherein angle $\alpha$ is determined by the equation:

$$\alpha = \text{arctg}\ nl/\pi d_p,$$

where n is the number of said roller heads, l is the distance between rollers, $d_p$ is the internal diameter of the pipe, and wherein said roller heads are shifted a distance relative to each other in a direction along said first longitudinal axis, a first portion of said bore is coaxial with the first longitudinal axis of the housing and a second portion of said bore is located on external surface of said housing, and said second end surface of the housing is coupled to a rotation drive of the housing through a holder by means of a flexible communication.

4. The device of claim 3, wherein the shifted distance between the roller heads is determined by the equation:

$$\Delta = l/n.$$

5. The device of claim 3, wherein said solid sediments on the internal surface of the pipe has a thickness t and, wherein said roller heads are configured so that a slope of the generatrix of said truncated cone confined in a plane which contains said second longitudinal axis of said truncated cone and passes a contact point between the truncated cone and internal surface of the pipe forms an angle, $\beta$, with a line on the internal surface of the pipe parallel to the first longitudinal axis and passing said contact point, $\beta$ is determined by the equation:

$$\beta = \text{arctg}\ lk/t,$$

wherein l is a distance between rollers, k is the number of rollers in the roller head, and t is the thickness of the solid sediments.

6. The device of claim 3, wherein the rollers in the roller head have a step structure and the number of rollers in each step is chosen to equal to the number of the number of the roller heads, wherein a last step in the step structure is adjacent to the first end surface of the housing.

7. The device of claim 6, wherein each said roller is made in the form of a disc with a thickness, the rollers of the last step has a flat edge and the thickness of the flat edge being in the range of 0.1 to 0.3 of the disc thickness of the last step.

8. The device of claim 3, wherein said second portion of the bore is spiraled in a direction that is opposite to the rotation of the housing.

* * * * *